US008474299B2

(12) United States Patent
Lutze et al.

(10) Patent No.: US 8,474,299 B2
(45) Date of Patent: Jul. 2, 2013

(54) CRIMPING TOOL

(75) Inventors: Peter Lutze, Bermbach (DE); Horst Hofmann, Unterschoenau (DE); Thomas Wagner, Bermbach (DE); Mathias Legler, Altersbach (DE); Michael Brueckner, Steinbach-Hallenberg (DE)

(73) Assignee: Rennsteig Werkzeuge GmbH, Viernau (DE)

( * ) Notice: Subject to any disclaimer, the term of this patent is extended or adjusted under 35 U.S.C. 154(b) by 215 days.

(21) Appl. No.: 12/737,312

(22) PCT Filed: Jul. 2, 2009

(86) PCT No.: PCT/EP2009/058366

§ 371 (c)(1),
(2), (4) Date: Dec. 29, 2010

(87) PCT Pub. No.: WO2010/000823

PCT Pub. Date: Jan. 7, 2010

(65) Prior Publication Data

US 2011/0094285 A1 Apr. 28, 2011

(30) Foreign Application Priority Data

Jul. 2, 2008 (DE) ..... 10 2008 031 346
Jan. 9, 2009 (DE) ..... 10 2009 004 209

(51) Int. Cl.
*B25B 7/12* (2006.01)
*B21J 7/16* (2006.01)

(52) U.S. Cl.
USPC ..... 72/409.12; 72/402

(58) Field of Classification Search
USPC ..... 72/409.01, 409.08, 409.11, 409.12, 72/409.13, 409.19, 121, 399, 402; 81/90.1, 81/303, 313
See application file for complete search history.

(56) References Cited

U.S. PATENT DOCUMENTS

| | | | | |
|---|---|---|---|---|
| 4,614,107 | A * | 9/1986 | Norin | 72/409.08 |
| 5,261,263 | A | 11/1993 | Whitesell | |
| 5,918,511 | A * | 7/1999 | Sabbaghian et al. | 81/128 |
| 6,176,116 | B1 | 1/2001 | Wilhelm et al. | |

FOREIGN PATENT DOCUMENTS

| | | |
|---|---|---|
| DE | 195 07 347 | 9/1996 |
| DE | 198 58 719 | 6/2000 |
| EP | 0 732 779 | 9/1996 |
| GB | 367 221 | 2/1932 |

OTHER PUBLICATIONS

International Search Report.

* cited by examiner

*Primary Examiner* — Teresa M Ekiert
(74) *Attorney, Agent, or Firm* — Collard & Roe, P.C.

(57) ABSTRACT

A crimping tool has crimping dies arranged in a star shape directed at a crimping region and subjected to rotational action radially outwards for the crimping movement by means of an actuating part. The crimping dies are mounted about an axis of rotation transversely to the longitudinal extent thereof for pivoting-in and form an abutment region on the crimping region side of the axis of rotation. A radial movement and/or circumferential movement is brought about to coincide with the rotational action on the crimping dies, in order to obtain abutment of a crimping die in the abutment region thereof against the counter-abutment region of another crimping die adjacent to the crimping die in the pivoting direction or counter-pivoting direction.

23 Claims, 13 Drawing Sheets

CRIMPING TOOL

CROSS REFERENCE TO RELATED APPLICATIONS

This application is the National Stage of PCT/EP2009/058366 filed on Jul. 2, 2009, which claims priority under 35 U.S.C. §119 of German Application No. 10 2008 031 346.7 filed on Jul. 2, 2008 and German Application No. 10 2009 004 209.1 filed on Jan. 9, 2009, the disclosures of which are incorporated by reference. The international application under PCT article 21(2) was not published in English.

BACKGROUND OF THE INVENTION

1. Field of Invention

The invention relates to a crimping tool with crimping dies, the crimping dies being arranged in a star-like layout directed toward a crimping region and being rotationally acted on, at a radially outward location, for the crimping movement, by means of an activating part, the crimping dies, furthermore, being mounted for pivoting-in about a pivot axis transverse to their longitudinal extent and forming an abutment region on the crimping-region side of the pivot axis.

2. Prior Art

Such a crimping tool is known, for example, from EP 0 732 779 B1. In the case of the known crimping tool, the crimping dies are illustrated as being in abutment against one another in each case in their abutment region. This is also a preferred state. The geometrical edge conditions, however, mean that, during the pivoting-in movement and also at the end of the pivoting-in movement, there is a relatively large gap between crimping-die surfaces which are associated with one another in the crimping region. Relatively large here means that, during a crimping operation, this can give rise to undesired distortion in the crimping region, i.e. penetration or bulging-out of the crimped article into the gap. This can result in problematic formations of the crimping region of a crimped wire end for example, the desire being for this crimping region to be, as far as possible, precisely angular corresponding to the crimping surfaces. As far as prior art is concerned, reference is also made to U.S. Pat. No. 5,261,263 A1.

SUMMARY OF THE INVENTION

Taking the disclosed prior art as a departure point, it is an object of the invention to provide a crimping tool for which, during a crimping operation, as far as possible no gaps occur between the crimping dies.

Further aspects are given in respect of further features of the invention as are explained hereinbelow. They may be important in their own right, or on a substitute or supplementary basis, in relation to the object which has already been mentioned.

A possible solution for achieving the object set out above is provided, according to a first concept of the invention, by the subject matter disclosed herein, this being based on the fact that the rotational movement of the crimping dies is accompanied by a radial movement and/or circumferential movement, for the purpose of achieving abutment of a crimping die, in its abutment region, against the counter-abutment region of a crimping die which is adjacent to this crimping die in the direction of pivoting or the direction counter to this. A crimping die is thus not only pivoted. It is addition also moved radially. As an alternative, or in addition, a circumferential movement may be provided, for example in that the (current) pivot point of the crimping die is shifted in the circumferential direction during the pivoting movement. Since the movement, in particular the radial movement, is controlled, for example by appropriate cam features, allowances can be made for the geometrical edge conditions, which result in the gap formation, as explained.

The crimping dies form, in the radially inward direction, a crimping space which decreases in size during the crimping movement. The crimping space is ideally a space with a circular cross-section. In reality, this is approximated by a polygonal cross-section. This crimping space, accordingly, gives rise to a polygonal cross-section of the workpiece which is to be crimped. The described abutment of the crimping dies gives rise to effective closure of this crimping space, at least in the critical phase of the pivoting movement of the crimping dies, when the workpiece is subjected to plastic deformation. As a result, a workpiece is prevented from penetrating into the abutment gap between the crimping dies. The workpiece is prevented from escaping out of the polygonal cross-section.

According to a further concept of the invention, it may be provided that the crimping die is formed in the manner of a link or can be pivoted with link guidance about a pivot axis outside its longitudinal center. This embodiment is based on the general teaching of finding the largest possible radius for the pivoting movement of the crimping die. The link guidance or link formation makes it possible to achieve the situation where the center point of rotation of the pivoting movement of the crimping die is advantageously shifted outward, possibly also beyond the radially outer end of the crimping die, and possibly beyond the housing. A large pivoting-movement radius can be achieved in that the variable gap width in the possible abutment regions which, in the absence of other measures, is necessarily established during pivoting of the crimping dies, remains small enough for it to be possible to avoid the situation where the workpiece undesirably escapes out of the crimping space into gaps which come about.

The features of the two possible solutions mentioned above may also be combined with one another.

Further features of the invention will be explained hereinbelow, also in the description of the figures.

A feature which is described as preferable can be considered as being only preferable—and not mandatory—even when another context makes reference to this without expressly emphasizing that such an embodiment is merely a preference. It is also the case in this other context that correspondingly, in addition to the more specific feature, the more general feature is also disclosed without this having to be repeated in the wording.

It is thus preferred if the radial movement is assisted by an energy store. This energy store, further preferably, is provided such that it constantly advances or biases the crimping die into the radially innermost position.

In a suitable, more concrete embodiment, the energy store may be provided by a spring.

Furthermore, it is preferred if a crimping die is accommodated in the radially outward direction in a positively locking pocket for rotational activation, and if the positively locking pocket has an oblique surface which interacts with a circumferentially oriented control extension of the crimping die such that the crimping die is moved radially.

In respect of the already mentioned link guidance, it may be provided that the crimping die is actuated by means of a link which is secured in a pivotable manner, on the one hand, to the crimping die and, on the other hand, to the activating part.

The link can be supported on the activating part, in particular, radially outside a radially outer end of the crimping die. It is also preferred if the link is supported on the crimping die radially outside the pivot axis of the crimping die. On the other hand, it is also possible to have a configuration in which the link is supported on the crimping die radially inward of the pivot axis.

It is particularly preferred, furthermore, if two links are provided, one of the links being supported, on the one hand, on the crimping die and, on the other hand, on a fixed bearing. The other link can then be supported on the activating part, so that the pivoting movement, and possibly radial movement, is achieved in this way.

Furthermore, it may preferably be provided that the crimping die, for the purpose of forming a virtual pivot axis, is guided by means of two fixed pivot pins which interact with slots. It is possible here for the fixed pivot pins to be provided on the crimping die and for the slots to form part of the housing. It is just as possible for this arrangement to be the other way round.

It is also possible for the fixed pivot pins to be provided on the crimping die and for the slots to form part of the housing, but, in relation to a pivoting axis of the crimping dies, to be provided on either side.

The crimping die itself may also be mounted for pivoting at its radially outer end region by means of a bearing pin accommodated in it. The end region here, in particular, is a radially outer third of the crimping die or a smaller part thereof, for example a quarter or a tenth of the overall radial extent of the crimping die. Furthermore, it may be provided that a crimping die, upon rotation in the pivoting-in direction, interacts with a control pin disposed between its end regions, that is to say the radially outer end region and the radially inner end region, by virtue of relative displacement in the longitudinal direction (radial direction). The end regions here are the same regions as those explained above in respect of the radially outer end region. The possible lengths mentioned, however, need not always be the same. There is therefore no need for a third of the length for the end region in the radially outward direction to correspond to a third of the length for the end region in the radially inward direction. The control pin accordingly performs, as it were, a stop function for the crimping die in the relevant direction and, at the same time, also an aligning function.

The control pin may preferably be disposed outside the crimping die. However, it may also be disposed within the crimping die, for example in a slot formed therein.

Furthermore, it is preferred if a surface of interaction which is formed on the crimping die for interaction with the control pin is curved. This curvature is "experienced" by the control pin as it moves along the crimping die during the aforementioned relative movement.

A further preferred embodiment, which is important, in particular, independently of a possible radial movement and/or a circumferential movement and/or of link guidance of the crimping dies, is realized in that the crimping dies are formed to interengage in their abutment region. This can be achieved in that the crimping dies interengage in a comb-like manner, that is to say in a plurality of layers. This also makes it possible to counteract the undesired influencing of the crimping result by gap formation.

A still further preferred embodiment, which is important at any rate, in particular, independently of a possible radial movement and/or circumferential movement and/or link guidance of the crimping dies, is realized in that the crimping dies are activated for movement in the radially inward direction as a linear movement and, over part of their movement, are displaced radially inward in abutment against one another in an abutment region. This part of the movement is, in particular, a final part of the movement in the radially inward direction, for example a tenth or more of the overall movement. Abutment of the crimping dies against one another can also be present over a third or a half of the movement or also throughout the entire movement. The aforementioned range, between a tenth of the movement and the entire movement, also includes any intermediate value, in particular in one-tenth increments, in relation to the overall length of the movement in the radially inward direction. In particular, it is preferred if the linear movement in the radially inward direction is accompanied by movement in the circumferential direction. This can be suitably provided, for example, by slots which are formed on the underside or upper side of the crimping dies, interacting with a fixed plate, and have a corresponding portion in the circumferential direction, fixed pins then running in these slots. This arrangement can also be provided the other way round in respect of fixed and moving elements.

As far as the construction of the crimping tool is concerned, it is possible to provide a lower plate which forms a base plate. In particular, it is possible for the lower plate to be fixed to a central guide protrusion or even to be formed in one piece therewith. This makes it possible to achieve central guidance of the rotary plates, and also central guidance of the crimping dies themselves, in particular in the cases where the crimping dies, which execute a pivoting movement and a longitudinal movement, are no longer sufficiently centered by their actual bearing location, in respect of the crimping region.

In particular, the plate which is referred to here as the carry-along plate is preferably guided by the guide protrusion.

BRIEF DESCRIPTION OF THE DRAWINGS

The invention will be explained in more detail hereinbelow with reference to the accompanying drawing, although the latter illustrates merely exemplary embodiments of the invention. In the drawing.

DETAILED DESCRIPTION OF THE DRAWINGS

Figure 1:
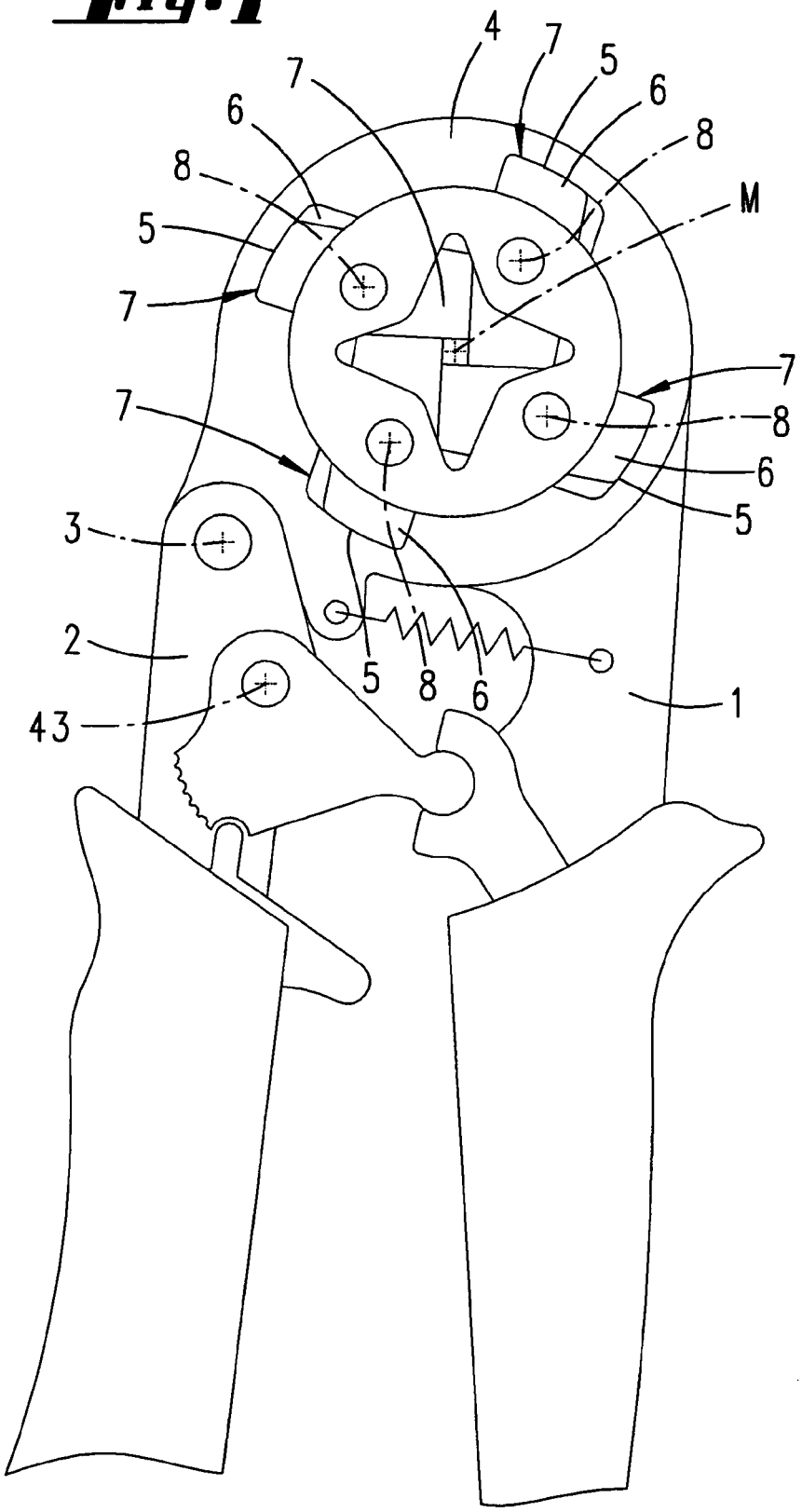
FIG. 1 shows a plan view of a crimping tool in the crimping region.
Figure 2:
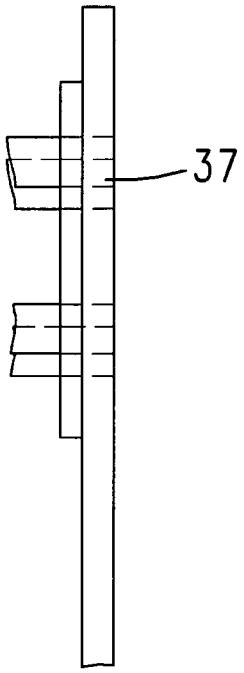
FIG. 2 shows a schematic side view of the subject matter of FIG. 1.

The basic construction of a crimping tool on which this invention is based will be illustrated and described, in first instance with reference to FIGS. 1 and 2.

In this respect, reference is also made to EP 0 732 779 B1, which has already been mentioned in the introduction and the content of which is hereby included in full in the disclosure of this application, also for the purpose of incorporating one or more features of the reference document in claims of this application.

The crimping tool in question here basically has handle parts 1 and 2. The handle part 2 is a movable handle part. It can be rotated about the axes 3 and 43, with a toggle being formed in the process. A toggle action is also achieved here. Connection to a carry-along (drive) plate 4 is also realized via the axis 3, positively locking pockets 5 being formed in this carry-along plate for ends 6 of the crimping dies 7. The crimping dies are driven by rotation of the carry-along plate 4.

A crimping die 7, furthermore, is mounted about a pivot axis 8 for pivoting-in purposes. The pivot axis 8 extends transversely to a longitudinal extent of a crimping die 7.

On the crimping-region side of the pivot axis 8, a crimping die 7 has an abutment region 9, which is directed counter to the direction of pivoting. In addition, a crimping die has, in a pivoting direction, a further, counter-abutment region 10, against which, in turn, an adjacent crimping die butts. It is preferred if at least the abutment region 9, as far as possible, is closed, i.e., in particular in the event of relatively high forces being applied, only a small gap, or no gap at all, is formed. The counter-abutment region 10 forms, in the direction of the center, to the extent that it is not covered by the abutment region 9, the crimping region.

According to one embodiment, the abutment surfaces of the crimping dies, which form the abutment region 9, are planar and/or, as seen in a projection as in the figures of the drawing, are rectilinear. However, they may also be curved to match one another, for which purpose reference is made, for example, to the embodiment of FIG. 18, see also hereinbelow in this respect.

Figure 3:
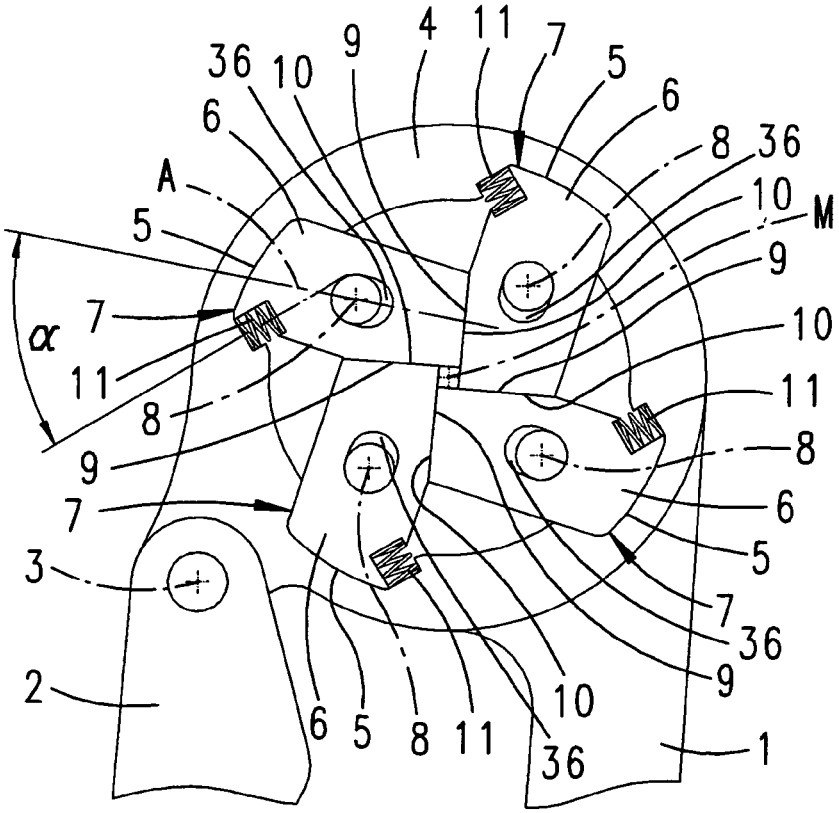
FIG. 3 shows an embodiment of a crimping tool with radial movement and spring biasing.
Figure 4:
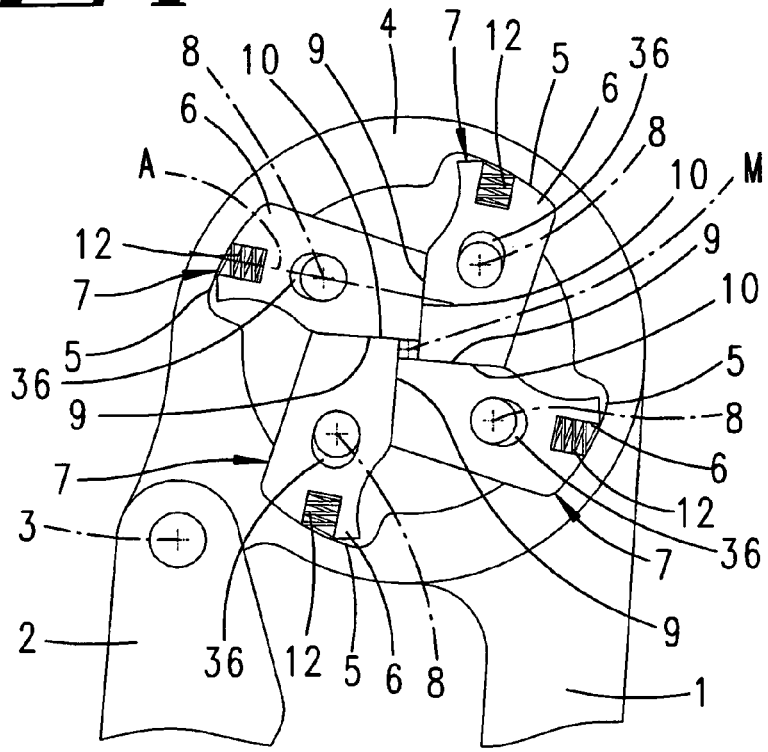
FIG. 4 shows an illustration according to FIG. 3, with a further method of disposing a spring.

For the purpose of achieving an action-influencing component which acts constantly in the radial direction and/or circumferential direction, and accompanies the pivoting movement, a spring 11 or 12 is provided in the case of the exemplary embodiments of FIGS. 3 and 4, respectively. As is evident, the spring is disposed at the foot end, associated with the positively locking pocket, of the crimping die 7, and is inset into the latter. It is located outside a longitudinal axis A of a crimping die 7, that is to say before the longitudinal axis A, as seen in the pivoting direction. The longitudinal axis A is formed here by a line which passes through the pivot axis 8 and a center point of the counter-abutment region 10. This gives rise, at the same time, to the desired force component in the direction accompanying the pivoting-in movement.

On the other hand, it is also possible, possibly in interaction with the supporting surface in the positively locking pocket, to have a central arrangement for a spring, as is the case with the spring 12 in the embodiment of FIG. 4.

Accordingly, it is possible for the springs to enclose, in their direction of action, an angle alpha of between 0° and 90° with the axis A.

In order to achieve the desired abutment of a crimping die 7, the pivot axis element 8 is accommodated in a slot 36. As is evident, the slot 36 has a direction of extent, or at least an extent component, in the radial direction and/or circumferential direction. A slot 36, further preferably, has a direction of extent which runs in the direction of action of the spring. Furthermore, it may also have a direction of extent which runs both through the spring and through the axis 8. Depending on the magnitude of the angle alpha, however, the direction of extent of the slot 36 may also coincide with the axis A.

In the case of the embodiment of FIG. 4, the longitudinal axis of the slot 36 coincides with the axis A. The end state of the crimping operation is illustrated here. The crimping die 7 butts radially outwardly against the wall of the positively locking pocket.

Figure 5:
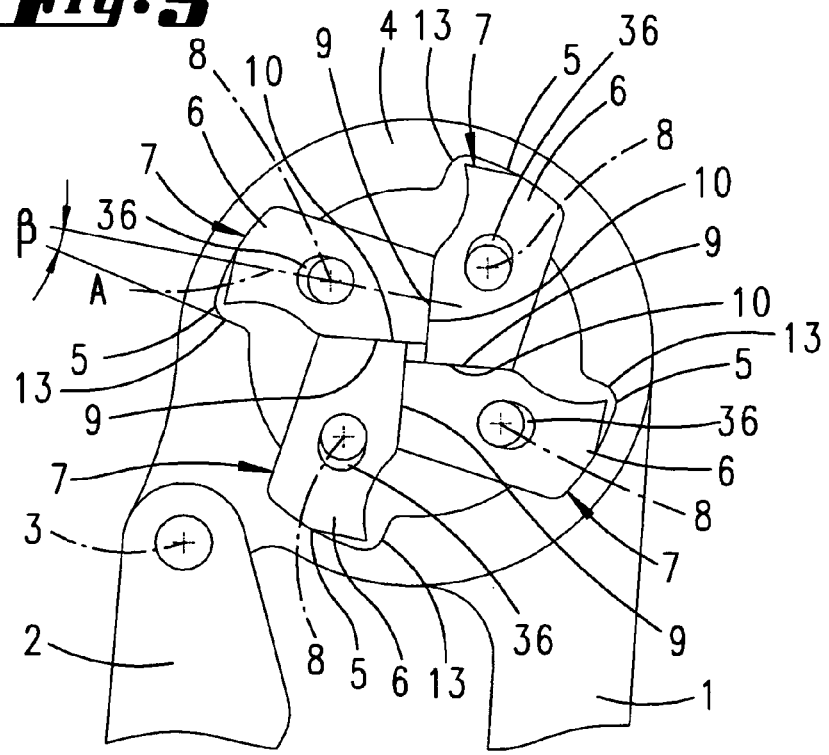
FIG. 5 shows a further embodiment, with an oblique surface for achieving the action-influencing component.

In the case of the embodiment of FIG. 5, for the purpose of achieving the action-influencing component, an activating surface of the positively locking pocket, the activating surface 13, is formed as an oblique surface. In addition, the associated end region of a crimping die 7 is seated in a close-fitting manner in the positively locking pocket, so that the desired force-action component is always achieved via the oblique surface 13. The oblique surface 13 can include an angle beta of between 1° and 89° with the axis A. It is also possible, in addition, for a spring to be provided once again, but this is not necessary.

Figure 6:
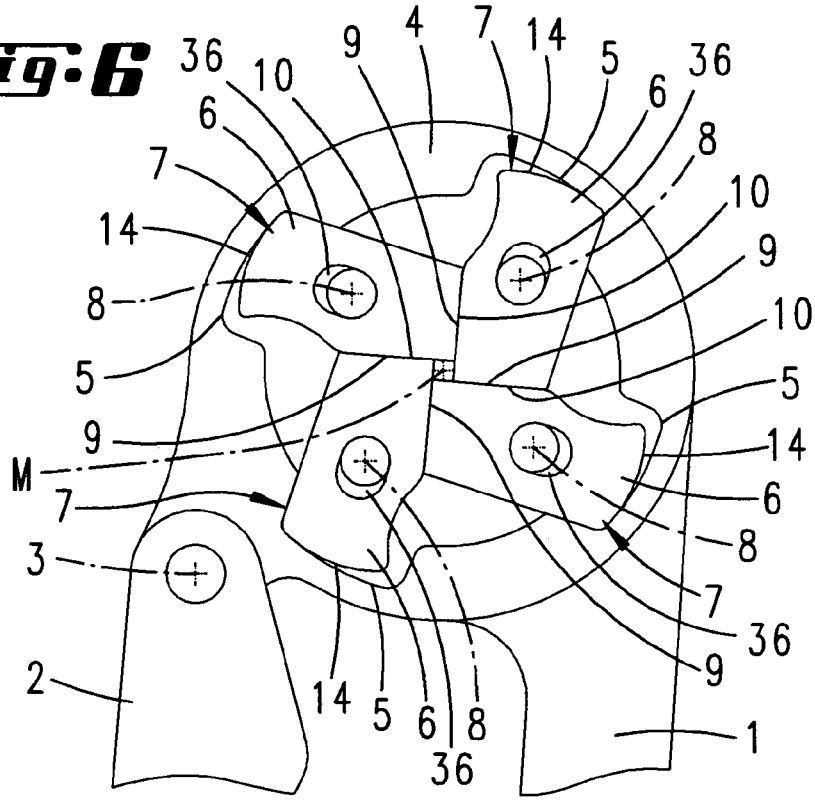
FIG. 6 shows a further embodiment, with a radially outer activating surface in a positively locking pocket.

In the case of the embodiment of FIG. 6, an activating surface 14 is formed at the base of the positively locking pocket, and this activating surface similarly, as a result of its configuration and in conjunction with the rolling action of the associated end surface of the crimping die 7, gives rise to the desired action-influencing force and, during the rolling action, allows the necessary compensation for play. It is also possible here, if appropriate, for spring action to be provided in addition for the purpose of resetting the crimping dies 7.

Figure 7:
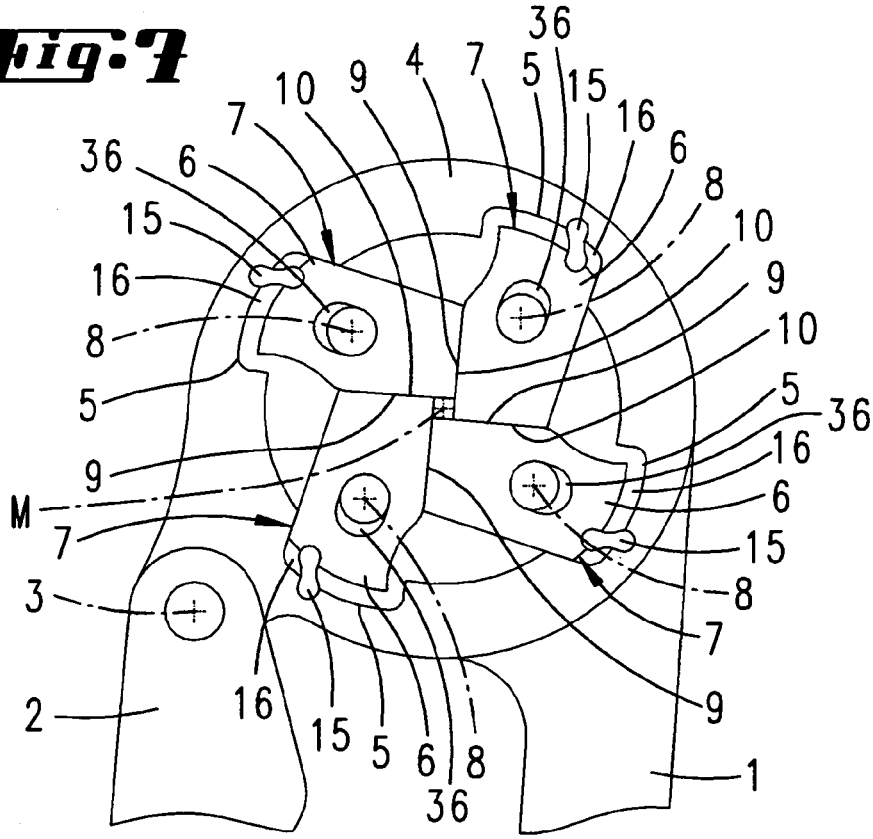
FIG. 7 shows a further embodiment, with link activation.

The embodiment of FIG. 7 provides a link 15 which is disposed, on the one hand, in a pivotable manner in the positively locking pocket and, on the other hand, in a pivotable manner in an associated foot region of the crimping die 7. It is evident here that a major part of that region of the crimping die which engages in the positively locking pocket 5 does not interact with the base 16 of the positively locking pocket. It is preferred for the interaction of the base 16 to take place only via the link 15. In the same way, it is also possible here for the aforementioned spring action to be provided for the purpose of resetting the crimping dies 7.

The mounting of the crimping dies on the pivot axis element 8 gives rise, during the pivoting-in movement, to a certain upstanding action by the link 15, and this action, since, as is evident, it is also established on the far side of the link axis, as seen in the pivoting direction, in relation to the longitudinal axis A, provides for the desired activating component. This gives rise to the abutment action in relation to a crimping die which is adjacent in the direction counter to the pivoting direction of the respective crimping die 7. In specific terms, the link 15 is provided here such that, at least at the beginning of the pivoting-in movement of the crimping dies 7, it is inclined in the direction of rotation of the plate 4 and then becomes appropriately upstanding. This means that, as seen in the direction of rotation of the plate 4, the bearing point of the link 15 in the plate 4 is formed before the bearing point of the link 15 in the crimping die 7. An angle which is formed by the longitudinal axis of the crimping dies and the axis of the link decreases in size as the closing movement increases.

Figure 8:
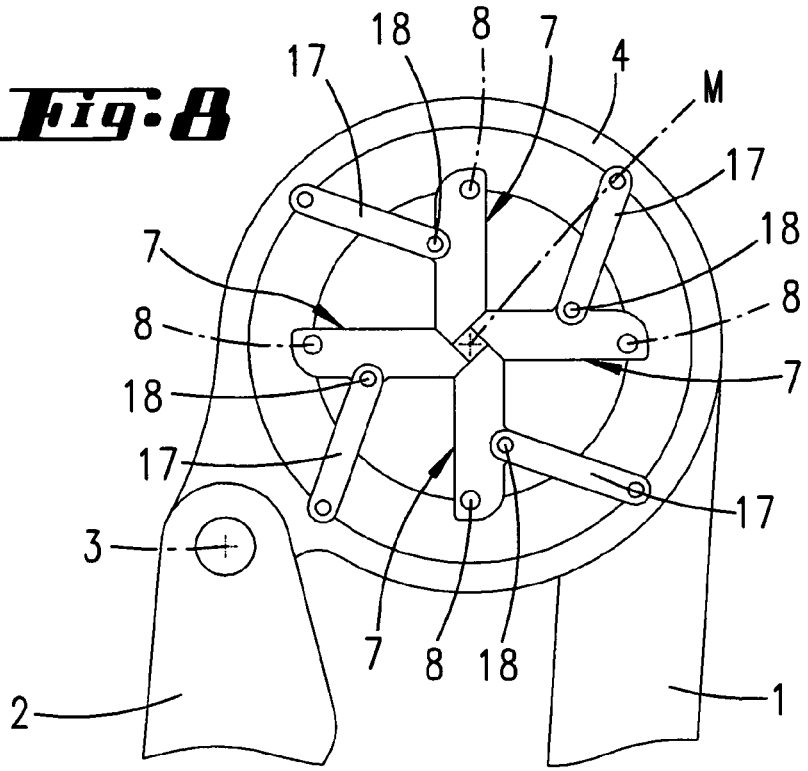
FIG. 8 shows an alternative embodiment to FIG. 7.

The subject matter of FIG. 8 provides a link 17 which is fixed, albeit in a pivotable manner, to the plate 4, which is rotated for the crimping movement. The link 17 is thus part of the drive. Furthermore, the link 17 is connected to the crimping die 7 such that it can be pivoted at a bearing point 18 that is radially inward in relation to the pivot axis 8 of the crimping die. Moreover, it is also the case here that the link 17 is mounted on the plate 4 before the pivot axis 8 of the crimping die 7, as seen in the direction of rotation of the plate 4. The pivot axis element 8 is not accommodated in a slot of a crimping die 7. But rather, the crimping die 7 is mounted only in a pivotable manner on the pivot axis element 8.

Figure 9:
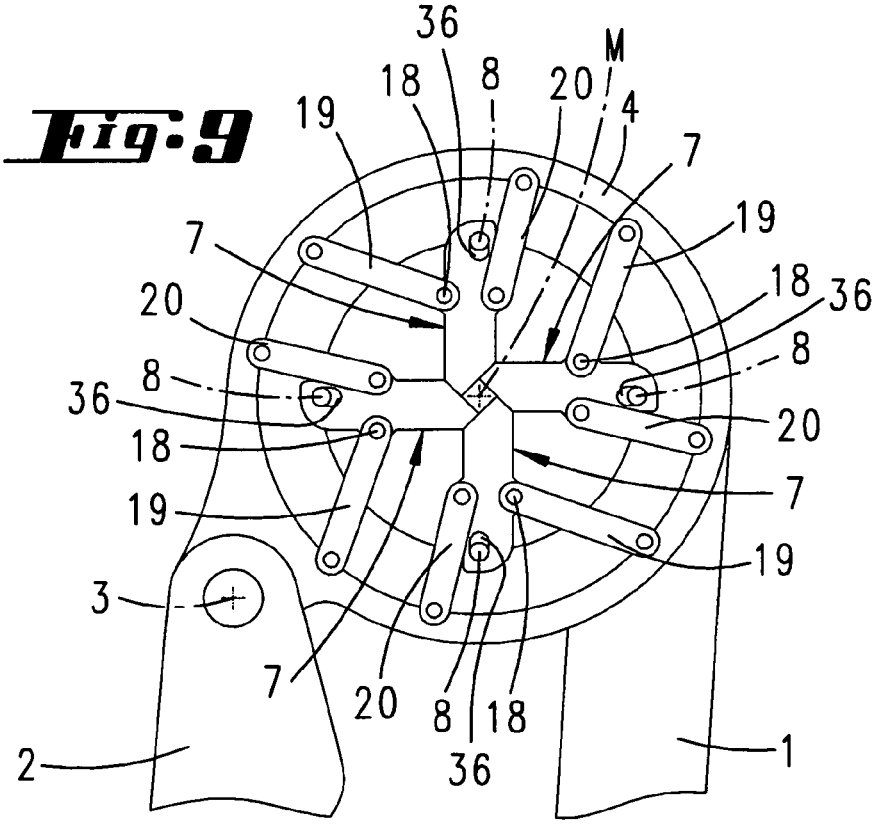
FIG. 9 shows an embodiment which forms a further alternative to FIGS. 7 and 8.

In the case of the embodiment of FIG. 9, a crimping die 7 is connected in each case to two links 19, 20. This is done basically in the same way as for the subject matter of FIG. 8, the only difference being that the links 19, 20 are articulated opposite one another on a crimping die 7, and are also articulated to the plate 4, one on one side and one on the other side of a longitudinal axis of the crimping die 7. The interaction of the links makes it possible to achieve in a very precise manner a pivoting-in movement with the desired action-influencing component. Here too, albeit quite differently from the embodiment of FIG. 8, the crimping dies 7 have their pivot axis elements 8 guided in slots 36.

Figure 10:
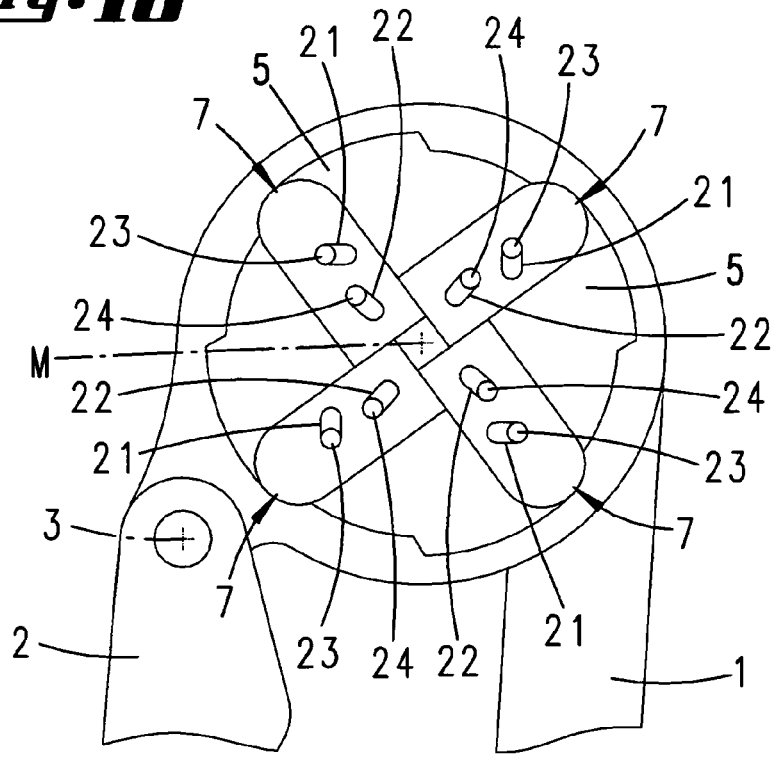
FIG. 10 shows a further embodiment with slots which interact with fixed pins.

In the case of the embodiment of FIG. 10, it is important that the crimping dies 7 have two slots 21, 22, each interacting with a fixed pivot pin 23, 24, respectively. The pivot pins are fixed to the housing. Moreover, the radially outer ends of the crimping dies 7 are acted on in the conventional manner in the positively locking pockets 5. The two slots give rise to a virtual axis of pivoting which can be adjusted very precisely and, at the same time, gives rise to the desired action-influencing component. The longitudinal axes of the slots 21, 22 preferably do not coincide. Further preferably, the longitudinal axis of the slot 22, which is disposed closer to the free, inner end of the crimping die 7, is at a smaller angle to the longitudinal axis A of the crimping die than the longitudinal axis of the slot 21, which is arranged further outwards in the radial direction. It is also possible here to provide a spring for the purpose of restoring the crimping dies 7.

Figure 11:
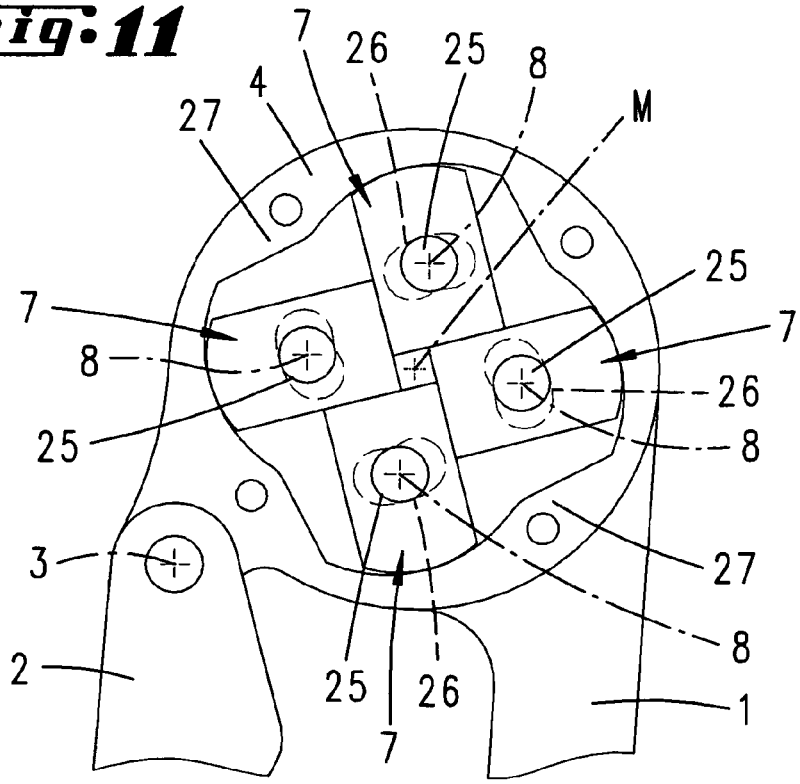
FIG. 11 shows an alternative embodiment to FIG. 10.

FIG. 11 illustrates an embodiment which realizes the basic concept of the crimping dies moving linearly inward along with a circumferential movement. Over part of their movement, in the case of the exemplary embodiment throughout the entire movement, the crimping dies butt against one another along correspondingly linear surfaces. The surfaces run either perpendicularly or parallel to the radially inwardly directed movement component. The abutment, here too, is such that effective closure of the crimping space is achieved, at least in the critical phase of the advancing movement of the crimping dies, when the workpiece is subjected to plastic deformation.

Figure 12:
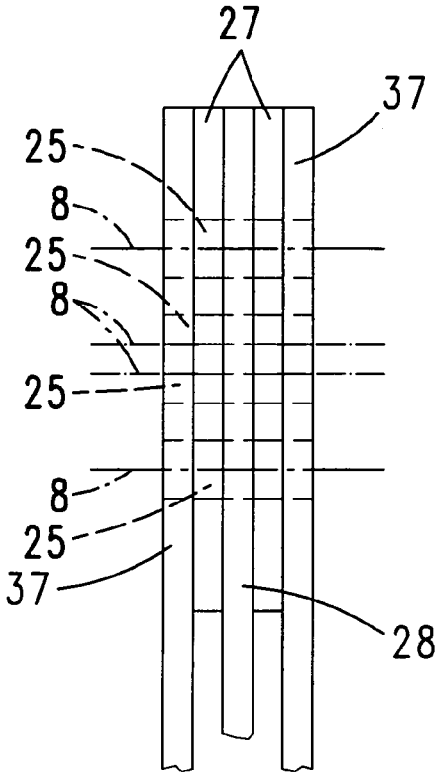
FIG. 12 shows a schematic side view of the subject matter of FIG. 11.

More specifically, in the case of the embodiment of FIG. 11, the crimping dies 7 are provided with guide pins 25 which are fixed on them and are guided in slots 26 of a lower plate, which is fixed to the housing. Also provided is a cam plate 27, or in the case of the exemplary embodiment, see FIG. 12, two cam plates 27, by means of which the drive of the crimping dies 7 is achieved. The pivoting movement is achieved by the interaction of the radially outer ends of the crimping dies 7 with a cam plate 28, which basically corresponds to the plate 4 described above. This embodiment can be explained further, additionally, according to FIGS. 12*a* to 12*f*.

Figure 12A:
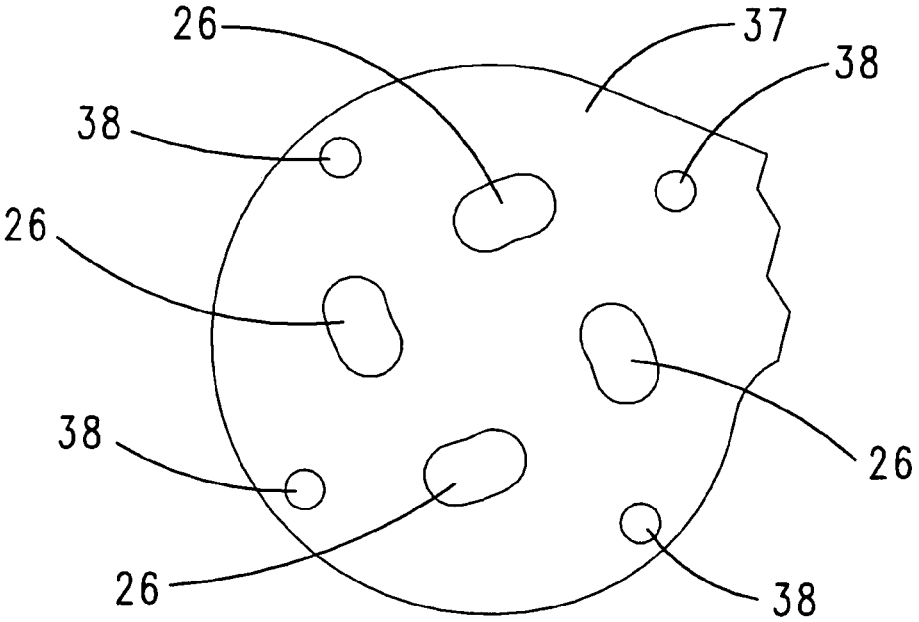
FIGS. 12*a*-12*c* show individual plates for constructing the tool according to FIGS. 11 and 12.
Figure 12B:
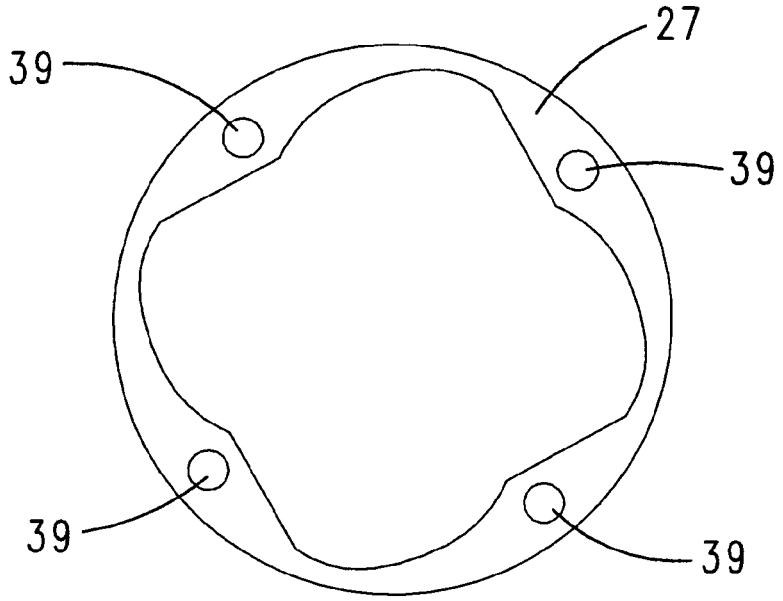
Figure 12C:
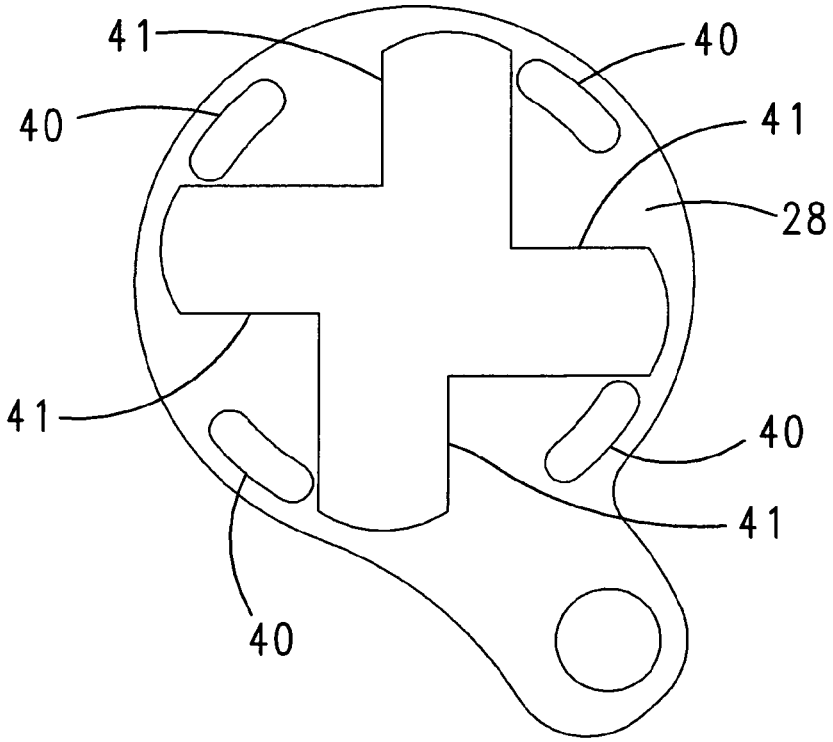

To provide further explanation, the essential elements are also illustrated in FIGS. 12*a* to 12*f*. FIG. 12*a* shows the lower plate 37, which is fixed to the housing and may also be referred to as the base plate. The slots 26 are formed herein, and the guide pins 25 run in the slots. The plate 37 also has rivet holes 38.

An identical base plate 37 is disposed opposite, also as an outermost plate in respect of the combination of plates described here.

A cam plate 27, or preferably a respective cam plate 27, is provided above and beneath the plate 37, and these cam plates are fixed to the respective plate 37 by means of rivets passing through the bores 39. The cam plate 28 is disposed in the center, the rivets running through slots 40 in this cam plate 28. The latter cam plate, which is used here, for all practical purposes, only for rotation, has more or less rectangular openings 41 which meet in the center and, in this case, serve for carrying along the crimping dies of matching shape that are seated therein.

The cam plate 28 has a drive portion 44, configured preferably as a drive tube, via which driving takes place by way of the movable handle part 2. The two plates 37 are connected to the fixed handle part 1.

Figure 12D:
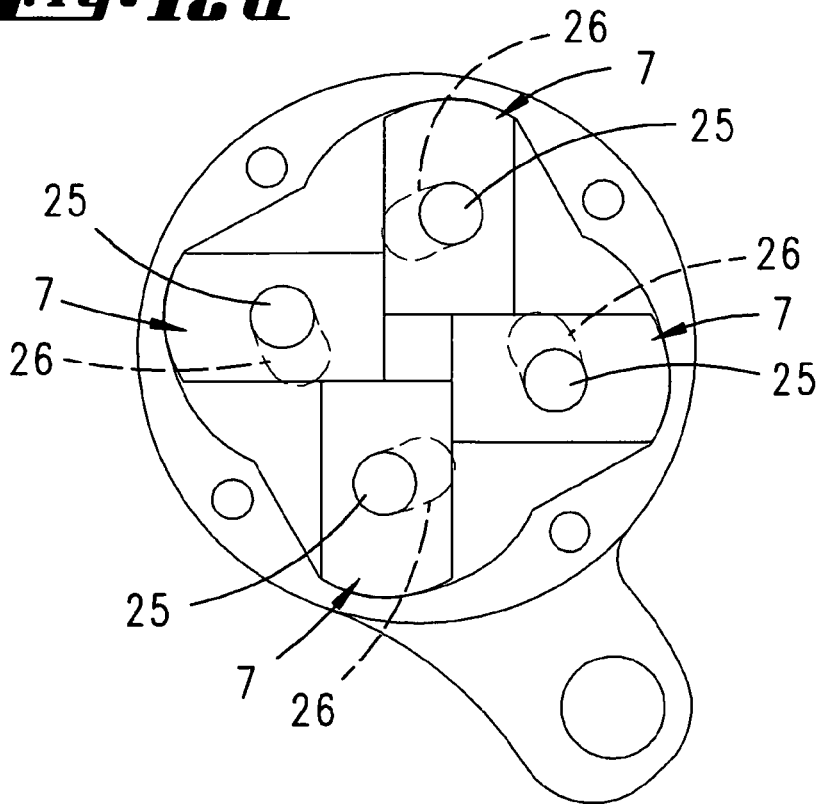
FIGS. 12*d*-12*f* show a movement sequence during crimping using a tool according to FIGS. 11 and 12.
Figure 12E:
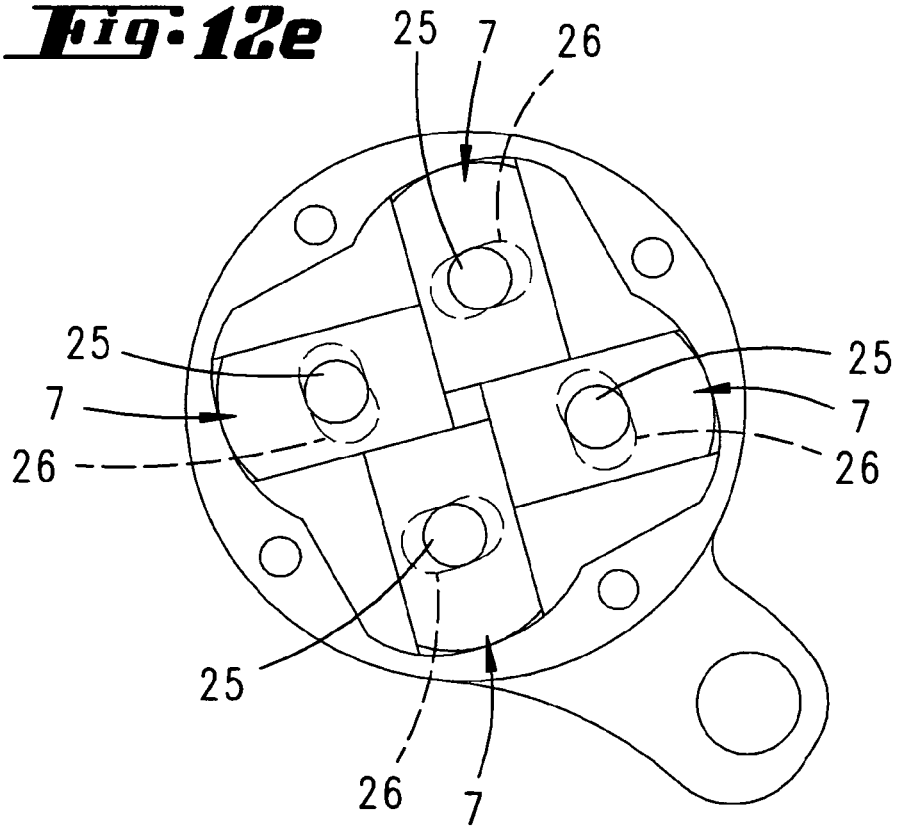
Figure 12F:
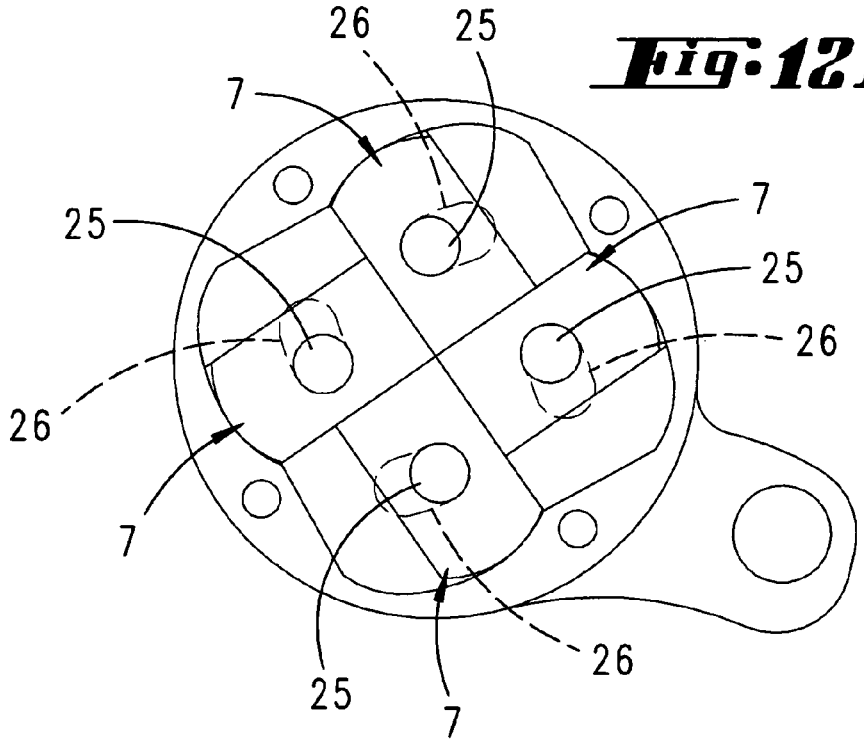

In respect of the cam plates 27, FIGS. 12*d* to 12*f* illustrate a movement sequence followed by the crimping dies during a crimping operation.

Figure 13:
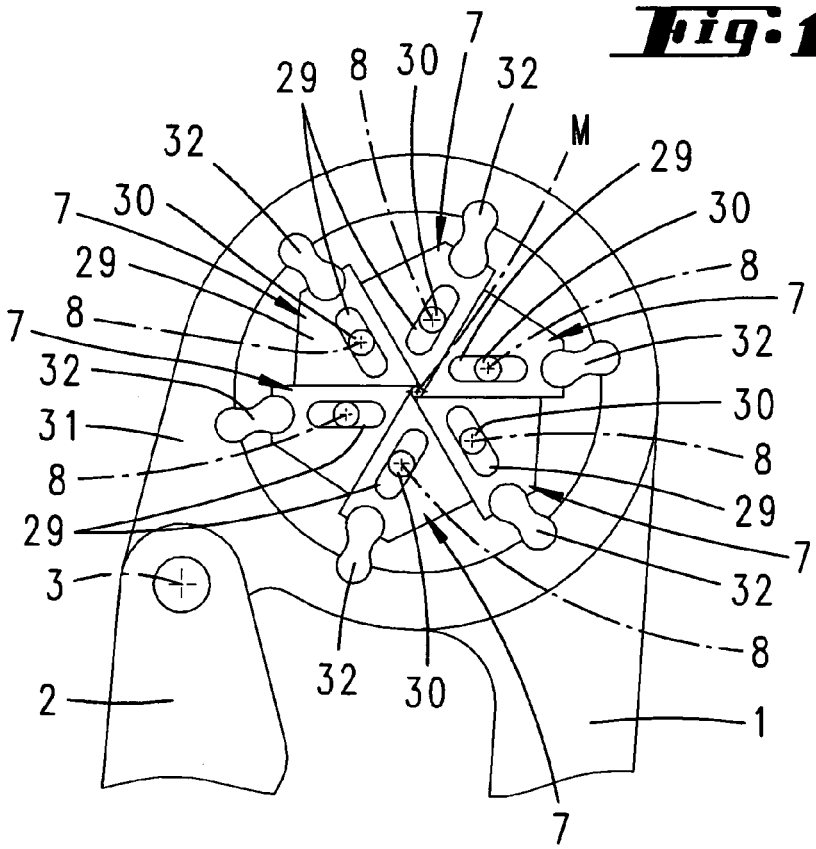
FIG. 13 shows an embodiment with a combination of link activation and slot formation in the crimping die.

The exemplary embodiment of FIG. 13 realizes, once again, a link-type solution. In addition, the crimping dies 7 have slots 29 in which run the pins 30, which are fixed to the housing. A pivot part 31, which also basically corresponds to the plate 4, is pivoted by corresponding movement of the hand regions and, in the process, achieves the basic upstanding movement, which has already been described above, of the links 32, which are mounted in a pivotable manner, on the one hand, in the pivot plate 31 and, on the other hand, in the foot region or associated end region of the crimping dies 7. The dimensions here, once again, are selected appropriately to achieve the influencing force, mentioned in the introduction, with regard to effecting abutment against an adjacent crimping die. Interaction of the crimping dies 7 with positively locking pockets is done away with completely. Instead, the crimping dies 7 are formed such that, as is achieved in the exemplary embodiment by way of a basically triangular configuration, they engage one another in such a way that a foot-end positively locking pocket is not necessary.

Figure 14:
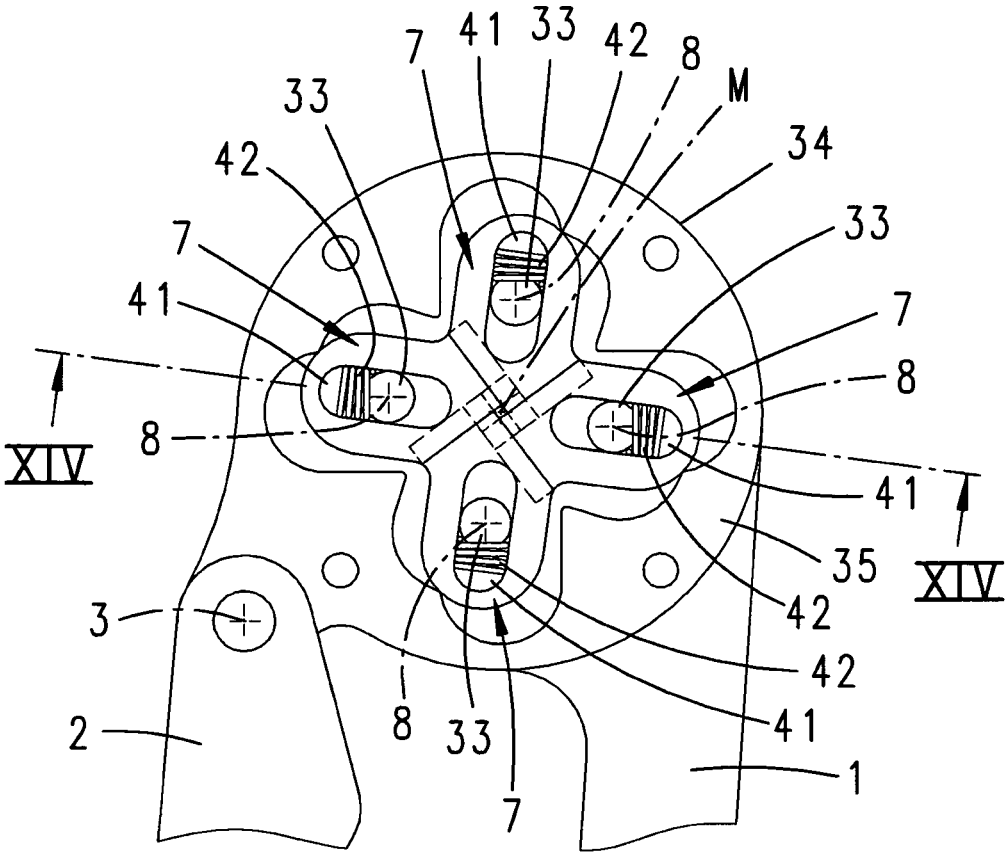
FIG. 14 shows an embodiment with interengagement in the region of the abutment regions of the crimping dies.
Figure 15:
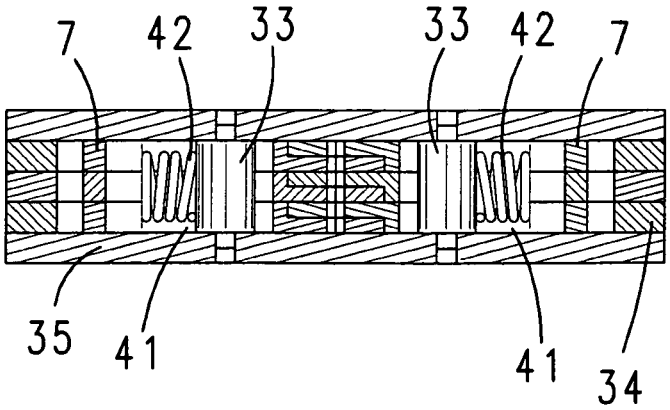
FIG. 15 shows a cross-section through the subject matter of FIG. 14, the section being taken along line XIV-XIV.

The interengagement of the crimping dies is important in the case of the embodiment of FIGS. 14 and 15. Freedom from gaps is achieved even just by this interengagement. Pins 33, which are fixed to the housing, are provided in addition. The crimping dies are driven, once again, by a cam plate 34, which for its part is connected to the base plate.

By virtue of the pivoting movement of the rotary plate 35, the crimping dies are moved along the cam plate and driven by this, so that they execute a linear play-free movement.

As is quite evident from FIG. 15 in particular, the crimping dies 7 interengage in a comb-like manner in their abutment region, in particular also on the crimping-region side. The circumferential overlapping of the offset, layer-like regions of engagement between adjacent crimping dies may correspond, for example, to 0.1 millimeters up to, for example, one or two or more millimeters. It is preferable for the overlapping to be provided, over part of the length of the crimping die, throughout the entire forward movement. This also achieves the desired guidance stability.

The crimping dies have slots 41, in which run the pins 33, which are fixed to the housing. The slots 41 extend in the axial direction A of the crimping dies 7. The crimping dies 7, furthermore, are biased toward the pins 33, by springs 42, in the slots 41, to be precise such that a respective crimping die 7 is forced radially outward as a result.

Figure 16:
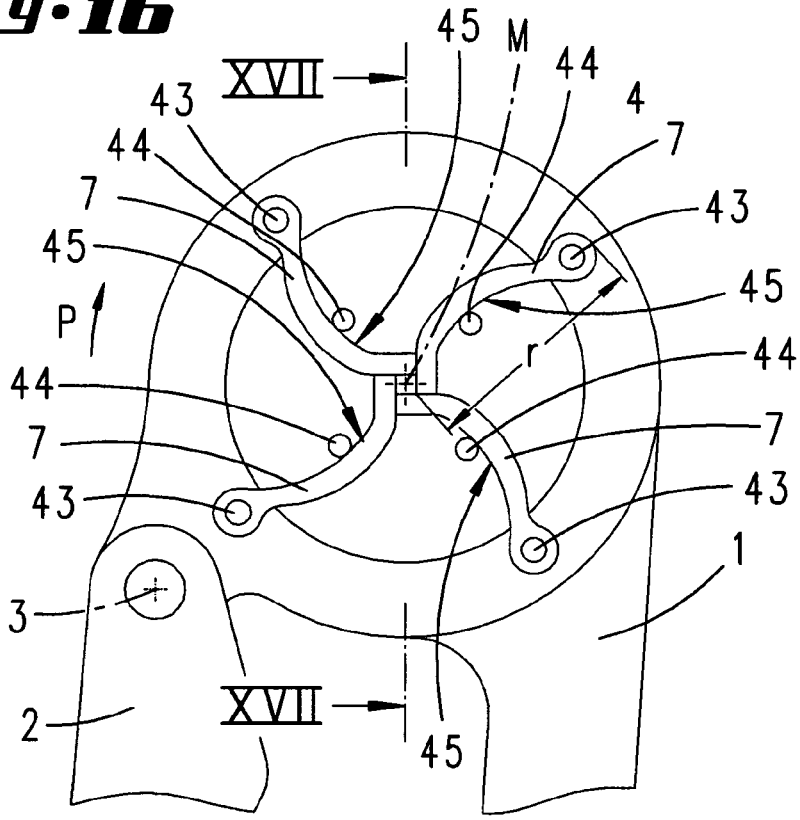
FIG. 16 shows a plan view of a further embodiment.
Figure 17:
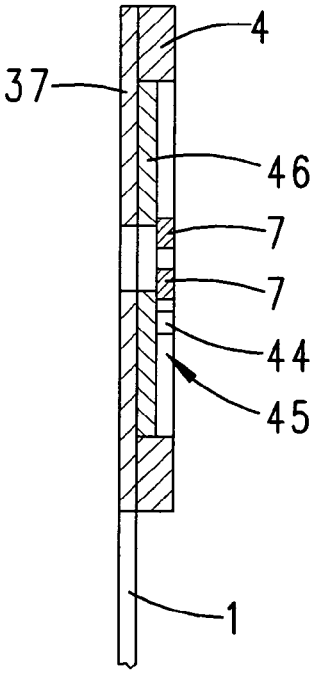
FIG. 17 shows a section through the subject matter of FIG. 16, the section being taken along line XVII-XVII.

In the case of the embodiment which is illustrated in FIGS. 16 and 17, the crimping dies 7 themselves are formed in the form of links. They are curved throughout in the case of the exemplary embodiment, but this is not mandatory. They are mounted at their radially outer end region by means of a bearing pin 43, which is accommodated in the crimping die 7. The bearing pin 43, at the same time, is fixed to the carry-along plate 4. In respect of a radial extent r of a crimping die 7, the bearing pin 43 is located in the radially outer end region, the end region accounting for approximately a fifth of this dimension. The bearing pin 43 is enclosed by a bearing-eyelet-like region of the crimping die 7.

Furthermore, in the case of this embodiment, a crimping die 7 interacts with a control pin 44. The control pin 44 is fixed. A pivoting-in movement, in arrow direction P of the carry-along plate 4, gives rise not just to a pivoting movement of the crimping die 7 about the control pin 44, but also to a certain relative movement. In terms of the crimping die being curved throughout, the control pin 44 is disposed on the inner side of the curvature. It is also the case that the control pin 44 has a surface of interaction with the crimping die 7, and this surface is curved. The surfaces here differ in curvature. The crimping die 7 moves in the radially outward direction relative to the control pin 44 during this pivoting-in movement. Since, further preferably, the surface of interaction on the associated outer side 45 of the crimping die 7 is formed with a certain degree of curvature in such a way that the curvature is in the plane of the drawing, this makes it possible for the crimping die to be acted on so as to enable the crimping die to be guided in a controlled manner, to be precise, in the present context, it allows controlled guidance in respect of gap minimization. Of course, this control surface or all four control surfaces of the crimping dies 7, of which there are four in the case of the exemplary embodiment, have to be formed, and coordinated with one another, so as to achieve the desired gap minimization.

The specific construction is evident from the cross-sectional illustration according to FIG. 17. The carry-along plate 4, which is connected to the handle part 2 for driving purposes, can be rotated relative to the base plate 37. The base plate 37 is fixed to the other handle part 1. Also disposed on the base plate 37 is a plate part 46, which is also fixed to the base plate 37. The plate part 46, at the same time, centers the carry-along plate 4 from the inside.

The control pins 44, of which only one can be seen in FIG. 17, are disposed on the plate part 46 and fixed thereto.

Figure 18:
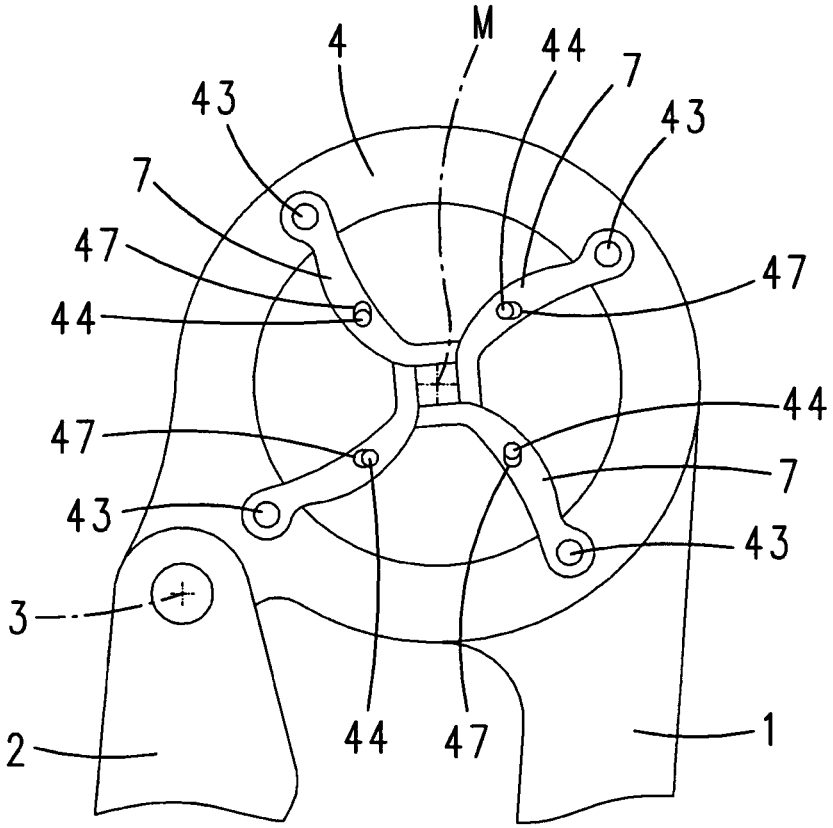
FIG. 18 shows a plan view of yet a further embodiment.

The embodiment of FIG. 18 corresponds, in principle, to the embodiment of FIGS. 16 and 17, the only difference being that, here, the control pins 44 are accommodated in slots 47, that is to say in the interior of a respective crimping die 7. It is also the case here that at least one side surface of a slot 47, which interacts with a control pin 44, is formed as a surface of interaction in the manner described above.

All features disclosed are (in themselves) pertinent to the invention. The disclosure content of the associated/attached priority documents (copy of the prior application) is hereby also included in full in the disclosure of the application, also for the purpose of incorporating features of these documents in claims of the present application.

The invention claimed is:

1. A crimping tool comprising:

a) a plurality of crimping dies arranged in a star shape directed toward a crimping region, wherein each crimping die of said plurality of crimping dies is mounted to pivot in about a respective pivot axis of said crimping die transverse to a respective longitudinal extent of said crimping die and to form a respective abutment region on a respective crimping region side of the respective pivot axis; and b) an activating part adapted to rotationally act on said plurality of crimping dies at a radially outward location to effect a crimping movement;

wherein a rotational activation of said plurality of crimping dies by said activating part is accompanied by at least one of a superimposed radial movement and a superimposed circumferential movement achieving an abutment of a respective abutment region of a first crimping die of said plurality of crimping dies with a counter-abutment region of a second crimping die of said plurality of crimping dies, said second crimping die being adjacent to said first crimping die in a pivoting direction or a counter pivoting direction.

2. The crimping tool according to claim 1, wherein said crimping die is formed as a link or can be pivoted with link guidance about a pivot axis outside a longitudinal center of said crimping die.

3. The crimping tool according to claim 1, wherein the radial movement is assisted by an energy store.

4. The crimping tool according to claim 3, wherein said energy store is a spring.

5. The crimping tool according to claim 1, wherein said crimping die is accommodated at a radially outward end in a positively locking pocket for rotational activation, and wherein said positively locking pocket has an oblique surface which interacts with a circumferentially oriented control extension of said crimping die such that said crimping die is moved radially.

6. The crimping tool according to claim 1, further comprising a link for actuating said crimping die, wherein said link is secured in a pivotable manner to said crimping die and to said activating part.

7. The crimping tool according to claim 6, wherein said link is supported on said activating part radially outside a radially outer end of said crimping die.

8. The crimping tool according to claim 6, wherein said link is supported on said crimping die radially outside the respective pivot axis of said crimping die.

9. The crimping tool according to claim 6, wherein said link is supported on said crimping die radially inward of the respective pivot axis.

10. The crimping tool according to claim 1, further comprising two links one of said two links being supported on said crimping die and on a fixed bearing.

11. The crimping tool according to claim 1, further comprising two fixed pivot pins interacting with a plurality of slots, wherein said two fixed pivot pins guide said crimping die for the purpose of forming a virtual pivot axis.

12. The crimping tool according to claim 11, wherein said two fixed pivot pins are provided on said crimping die and said plurality of slots form part of a housing.

13. The crimping tool according to claim 12, wherein said two fixed pivot pins and said plurality of slots are provided on either side in relation to a pivoting plane of said plurality of crimping dies.

14. The crimping tool according to claim 11, wherein said two fixed pivot pins are fixed to a housing and said plurality of slots are formed in said crimping die.

15. The crimping tool according to claim 1, wherein said plurality of crimping dies are formed to interengage in their abutment region.

16. The crimping tool according to claim 1, wherein a lower plate, which forms a base plate, is fixed to a central guide protrusion.

17. The crimping tool according to claim 16, wherein a carry-along plate is guided on said central guide protrusion.

18. The crimping tool according to claim 1, wherein said crimping die is mounted for pivoting at radially outer end region with a bearing pin accommodated in said crimping die.

19. The crimping tool according to claim 1, further comprising a control pin disposed between end regions of said crimping die, wherein upon rotation of said crimping die in a pivoting in direction, said crimping die interacts with said control pin by virtue of a relative displacement in a longitudinal direction (radial direction).

20. The crimping tool according to claim 10, wherein said control pin is disposed outside said crimping die.

21. The crimping tool according to claim 19, wherein said control pin is disposed within said crimping die in a slot formed therein.

22. The crimping tool according to claim 19, wherein a curved surface of interaction is formed on said crimping die for interaction with said control pin.

23. The crimping tool according to claim 19, wherein a curved surface of interaction is formed on said control pin for interaction with said crimping die.

* * * * *